US006683227B2

(12) United States Patent
Platz et al.

(10) Patent No.: US 6,683,227 B2
(45) Date of Patent: Jan. 27, 2004

(54) RESOURCE RECOVERY OF WASTE ORGANIC CHEMICALS BY THERMAL CATALYTIC CONVERSION

(76) Inventors: Gerald M. Platz, 108 Hwy. Division, Conroe, TX (US) 77304; James C. Holste, 3025 Hummingbird Cir., Bryan, TX (US) 77807-3224; Dawid J. Duvenhage, 3025 Hummingbird Cir., Bryan, TX (US) 77807-3224

( * ) Notice: Subject to any disclaimer, the term of this patent is extended or adjusted under 35 U.S.C. 154(b) by 14 days.

(21) Appl. No.: 09/880,653

(22) Filed: Jun. 13, 2001

(65) Prior Publication Data

US 2003/0009068 A1 Jan. 9, 2003

(51) Int. Cl.[7] ..... C10G 1/10; C07C 1/00

(52) U.S. Cl. ..... 585/241; 201/2.5; 201/25

(58) Field of Search ..... 585/241, 240, 585/242; 201/215, 25

(56) References Cited

U.S. PATENT DOCUMENTS

| | | | | |
|---|---|---|---|---|
| 2,355,446 A | | 8/1944 | Komarewsky et al. | |
| 3,829,558 A | * | 8/1974 | Banks et al. | 423/481 |
| 4,273,643 A | * | 6/1981 | Bennett | 208/8 R |

(List continued on next page.)

FOREIGN PATENT DOCUMENTS

| | | | |
|---|---|---|---|
| GB | 1575053 | 9/1980 | C10G/11/08 |

OTHER PUBLICATIONS

Wojtowicz et al., "Pyrolysis of Scrap Tires: Can It Be Profitable?", Advanced Fuel Research, Inc., *ACS Chemtech*: pp. 48–53 (1996).

Teng, et al, "Reprocessing of Used Tires into Activated Carbon and Other Products", Advanced Fuel Research, Inc., *Ind. Eng. Chem. Res.*, 34: pp. 3102–3111 (1995).

Larsen et al., "Conversion of Scrap Tires by Pyrolysis in Molten Salts", Dept. of Chem., Univ. of Tennessee, *ACS Rubber Chemistry and Technology*. 49: pp. 1120–1128.

Palmer et al., "Co–conversion of Coal/Waste Plastics Mixtures Under Various Pyrolysis and Liquefaction Conditions", ACS Division of Fuel Chemistry Seminar (1995).

(List continued on next page.)

*Primary Examiner*—Bekir L. Yildirim
(74) *Attorney, Agent, or Firm*—Howrey Simon Arnold & White, LLP

(57) ABSTRACT

A process for the thermocatalytic conversion of waste organic materials (e.g., waste tires) into reusable hydrocarbons is provided. The process entails providing the feedstock and catalyst comprising $AlCl_3$ to a heated, stirred reactor. An overhead portion of vaporized hydrocarbons as well as vaporized $AlCl_3$ is initially removed from the reactor via a discharge port. The composition of the removed hydrocarbons will vary depending on which of three modes the process is run: low reactor pressure, partial vacuum, and high pressures. Vaporized $AlCl_3$ and a certain fraction of the hydrocarbons are subsequently removed via condensation and returned to the reactor. The composition of the condensed hydrocarbon fraction is controlled based on vapor pressure. The remaining vaporized hydrocarbon is recovered for subsequent uses. A reactor discharge portion is also removed from the reactor. This portion may contain unreacted feedstock and catalyst. The reactor discharge portion is provided to a supplemental reactor in which additional vaporized hydrocarbons and additional vaporized $AlCl_3$ catalyst are produced. The additional vaporized hydrocarbons and additional vaporized $AlCl_3$ catalyst are removed from the supplemental reactor and provided to a recycle catalyst condenser in which the additional catalyst is condensed while the additional hydrocarbons are maintained in the vapor state. The condensed additional catalyst as well as make-up catalyst are provided to the reactor to maintain appropriate catalyst to feedstock ratios. The additional hydrocarbons are recovered for subsequent uses. Any remaining residuals contained in the supplemental reactor are subjected to solid residue treatment, which includes carbon black recovery.

24 Claims, 7 Drawing Sheets

U.S. PATENT DOCUMENTS

| | | | | | |
|---|---|---|---|---|---|
| 4,735,703 | A | | 4/1988 | Sato et al. | 208/25 |
| 5,167,772 | A | | 12/1992 | Parker, Sr. | 202/105 |
| 5,283,318 | A | | 2/1994 | Saleh et al. | 528/481 |
| 5,336,595 | A | | 8/1994 | Strader et al. | 435/6 |
| 5,364,996 | A | | 11/1994 | Castagnoli et al. | 585/241 |
| 5,386,070 | A | | 1/1995 | Evans et al. | 585/241 |
| 5,389,691 | A | | 2/1995 | Cha et al. | 521/41 |
| 5,414,169 | A | * | 5/1995 | Takahashi et al. | 585/241 |
| 5,435,890 | A | | 7/1995 | Munger | 202/93 |
| 5,449,438 | A | | 9/1995 | Jagau et al. | 201/10 |
| 5,464,503 | A | | 11/1995 | Avetisian et al. | 201/3 |
| 5,487,239 | A | | 1/1996 | Jenkins et al. | 49/498.1 |
| 5,487,510 | A | | 1/1996 | Ficker | 241/199.6 |
| 5,492,561 | A | | 2/1996 | Flanigan | 106/273.1 |
| 5,504,267 | A | * | 4/1996 | Platz | 585/241 |
| 5,506,274 | A | | 4/1996 | Brown | 521/41 |
| 5,543,061 | A | * | 8/1996 | Baskis | 210/774 |
| 5,582,215 | A | | 12/1996 | Yamamoto et al. | 140/105 |
| 5,608,136 | A | | 3/1997 | Maezawa et al. | 588/228 |
| 5,611,492 | A | | 3/1997 | Hunt et al. | 241/23 |
| 5,618,852 | A | | 4/1997 | Adkins | 521/43.5 |
| 5,634,599 | A | | 6/1997 | Khais et al. | 241/23 |
| 5,656,942 | A | | 8/1997 | Watts et al. | 324/754 |
| 5,738,025 | A | | 4/1998 | Tachibana | 110/346 |
| 5,753,086 | A | | 5/1998 | Guffey et al. | 202/88 |
| 5,780,696 | A | * | 7/1998 | Bauer | 585/241 |
| 5,847,248 | A | * | 12/1998 | Bridle et al. | 585/240 |
| 5,865,956 | A | * | 2/1999 | Bridle et al. | 202/117 |
| 5,917,102 | A | * | 6/1999 | Holighaus et al. | 585/241 |
| 6,133,491 | A | * | 10/2000 | Xing | 585/241 |
| 6,139,723 | A | * | 10/2000 | Pelrine et al. | 208/422 |
| 6,190,542 | B1 | * | 2/2001 | Comolli et al. | 208/423 |
| 6,387,221 | B1 | * | 5/2002 | Schoenhard | 201/25 |

OTHER PUBLICATIONS

Orr et al., "Thermal and Catalytic Coprocessing of Coal and Waste Materials", ACS Division of Fuel Chemistry Seminar (1995).

Westerhout et al., "Development of a Continuous Rotating Cone Reactor Pilot Plant for the Pyrolysis of Polyethylene and Polypropylene", *Ind. Eng. Chem. Res.* 37: pp. 2316–2322 (1998).

Westerhout et al., "Recycling of Polyethylene and Polypropylene in a Novel Bench–scale Rotating Cone Reactor by High Temperature Pyrolysis", *Ind. Eng. Chem. Res.* 37: pp. 2293–2300 (1998).

San Miguel et al., "Pyrolysis of Tire Rubber: Porosity and Adsorption Properties Characteristic of Pyrolytic Chars", *Ind. Eng. Chem. Res.* 37: pp. 2430–2435 (1998).

* cited by examiner

RESOURCE RECOVERY OF WASTE ORGANIC CHEMICALS BY THERMAL CATALYTIC CONVERSION

FIELD OF THE INVENTION

The present invention relates to a process for the thermocatalytic conversion of waste organic materials, including used tire rubber, waste plastics, and used motor oils and lubricants, into lower molecular weight hydrocarbons and the concomitant recovery of solids present in the initial feedstocks.

BACKGROUND OF THE INVENTION

Currently in every industrialized country in the world there are huge quantities of discarded used tires that are a haven for vermin and insects, as well as being a serious fire hazard. For example, in the United States by recent estimates, approximately 260 million tires are discarded each year. In addition to the flow of newly generated scrap tires, it is estimated in excess of 2 billion scrap tires are already stored in piles around the United States. The situation is essentially the same around the world. There has been considerable research and development into providing a solution for the disposal of used tires.

A substantial effort has been directed toward finding uses for used tires. Of these estimated 260 million used tires discarded each year, as much as 70% have potential uses as fuel in various kilns and boilers while about 13% are used in rubber product applications, both supported by partial subsidies. There is a modest consumption of used tires comminuted to crumb rubber for use in molding and sheeting of low value rubber products. The majority of disposal techniques studied, such as pyrolysis, are for technical reasons generally unable to support themselves economically.

Tires generally are composed of rubber, carbon black, steel, fabric, and additives. Styrene-butadiene rubber is most commonly used in tire manufacture, usually in combination with other elastomers such as natural rubbers, isoprenes, and ethylene-propylene diene rubbers. Various carbon blacks, sometimes blended with finely divided silica, are used in tires to strengthen the rubber and improve the resistance of the rubber to abrasion. It is not unusual that as many as four or five different carbon blacks are used in building a single tire. Other additives, such as extender oils, antioxidants, and antiozonates are used in tire manufacturing to slow the atmospheric oxidative cracking of the tire rubber. Finally, a small percentage of fillers, such as titanium dioxide, a pigment, may be present to provide such things as the esthetics of white wall tires.

The synthesis of tire rubber is a polymerization process. Polymerization is a process wherein individual monomers, such as styrene and butadiene, join together in large numbers to form a polymer molecule. When two dissimilar molecules, such as styrene and butadiene, join together to form a polymer chain, a copolymer is produced. There are two broad classes of polymers and copolymers based on their polymerization procedure. One class is based on condensation polymerization, producing condensation polymers, such as polyesters, nylons, polycarbonates, and polyurethanes. These polymers have a molecular weight lower than the sum of the molecular weights of the monomers used to produce them. The other class of polymers are known as addition polymers, whose molecular weight is the sum of the molecular weights of the monomers used to make them. Addition, or chain growth polymers, are made in specific conditions of temperature and pressure and in the presence of a catalyst or reaction initiator. SBR (styrene butadiene rubber), EPDM (ethylene propylene diene monomer) rubber, polyethylene, polypropylene, and polystyrene, to name a few, are addition polymers.

In addition to used tires, a considerable tonnage of waste commodity plastics, or polymers, are improperly disposed of each year. In the last few years, there has been considerable improvement in the collection and recycling of common waste polymers. However, the recycling and reuse of waste polymers, as now practiced without subsidies, has proven to be uneconomic, forcing the abandonment of many recycling efforts. The recycling of waste polymers as fuel has not proven practical because of the inability to collect sufficient quantities to sustain operation.

Finally, in addition to used tire rubber and waste commodity plastics, a significant quantity of used motor oil, lubricants, and various other organic chemicals are disposed of wastefully. This quantity of disposed motor oil and lubricants represents a significant waste of a potential source of base organic chemicals that, if recovered, could be used in a variety of applications. Thus, a better way of converting waste organic chemicals is needed.

There have basically been two methods to break down used tire rubber, waste polymers, used motor oil and lubricants, and other waste organic materials into base organic chemicals that can be reused: pyrolysis and depolymerization. Of these two methods, the most commonly employed has been pyrolysis, in which the waste organic material feedstock is converted into commercial products such as hydrocarbons and carbon blacks. Pyrolysis is the thermal degradation in the absence of oxygen. It is commonly conducted at temperatures in the range of 650° to 800° C. Pyrolysis, because of the conditions at which it is employed, commonly results in the production of low value hydrocarbons and low quality, low activity carbon black. Despite assertions to the contrary, no pyrolysis process is known to have been in operation for sustained periods producing valuable reinforcing grade carbon blacks at a profit. Thus, current, and probably any future, pyrolysis processes are liable to be both technically and economically unattractive.

In depolymerization processes, a given polymer, subjected to conditions above its depolymerization temperature, breaks down into the individual monomers that comprise the polymer. For example, polystyrene and polypropylene will depolymerize into styrene and propylene, respectively. Accordingly, depolymerization processes are not capable of producing a wide range of hydrocarbons that can be used to produce compounds other than the same polymers initially subjected to the depolymerization process.

In view of the foregoing, a desirable process would be capable of processing waste organic materials, including waste tire rubber as well as waste plastics, regardless of its source or composition, to yield hydrocarbons. These hydrocarbons could be used to produce the base organic compounds of the initial waste organic materials subjected to the process but could additionally be used to produce entirely different compounds. A desirable process would also be capable of processing other waste organic materials, such as used motor oil and lubricants. A desirable process would also be capable of separating and/or recovering solids present in these initial feedstocks. Moreover, the presence of antioxidants and antiozonates would not pose a problem for such a desirable process. Additionally, a desirable process would be able to accommodate at least some level, albeit of reduced size, of steel fibers, fiberglass, and/or fabric that might be present in the initial feedstock of waste organic materials, particularly a feedstock comprising used tire rubber. A desirable disposal process should be able to simultaneously process several commingled dissimilar feedstocks, such as tire rubber, used motor oil, waste polymers, waste lubricants, and others. The present invention directed to a thermocatalytic conversion process provides the aforementioned needs.

SUMMARY OF THE INVENTION

In accordance with one aspect of the invention, there is provided a continuous process for the thermocatalytic conversion of a feedstock of waste organic materials into reusable hydrocarbons. The process entails providing the feedstock and a catalyst comprising aluminum trichloride ($AlCl_3$) to a heated, stirred reactor maintained at pressures and at temperatures sufficient to maintain $AlCl_3$ as a fluid. The process can be conducted in 3 modes: (1) low reactor pressure, (2) partial vacuum, and (3) high reactor pressure.

As feedstock is converted into vaporized hydrocarbons, vaporized hydrocarbons and vaporized $AlCl_3$ are removed from the reactor. $AlCl_3$ and a certain fraction of the hydrocarbons can be subsequently condensed and returned to the reactor. The composition of the condensed hydrocarbon fraction is controlled based on vapor pressure. The remaining uncondensed vaporized hydrocarbon is recovered as product.

In accordance with another aspect of the invention, a reactor discharge portion is also removed from the reactor. This portion may contain unreacted feedstock and $AlCl_3$ catalyst. The reactor discharge portion is provided to a supplemental reactor maintained at temperatures sufficient to generate additional vaporized hydrocarbons and to vaporize residual $AlCl_3$. The additional vaporized hydrocarbons and additional vaporized $AlCl_3$ catalyst are removed from the supplemental reactor and provided to a recycle catalyst condenser wherein the hydrocarbons are separated for recovery and wherein at least a portion of the additional vaporized $AlCl_3$ is condensed and returned to the reactor. Make-up catalyst is provided to the recycle catalyst condenser and then to the reactor to maintain appropriate catalyst to feedstock ratios. While the entire quantity of additional hydrocarbons provided to the recycle catalyst condenser can be recovered for subsequent uses, a fraction may be condensed and returned to the reactor.

In accordance with another aspect of the invention, any remaining residuals contained in the supplemental reactor are subjected to subsequent processes to recover carbon black.

Figure 1:
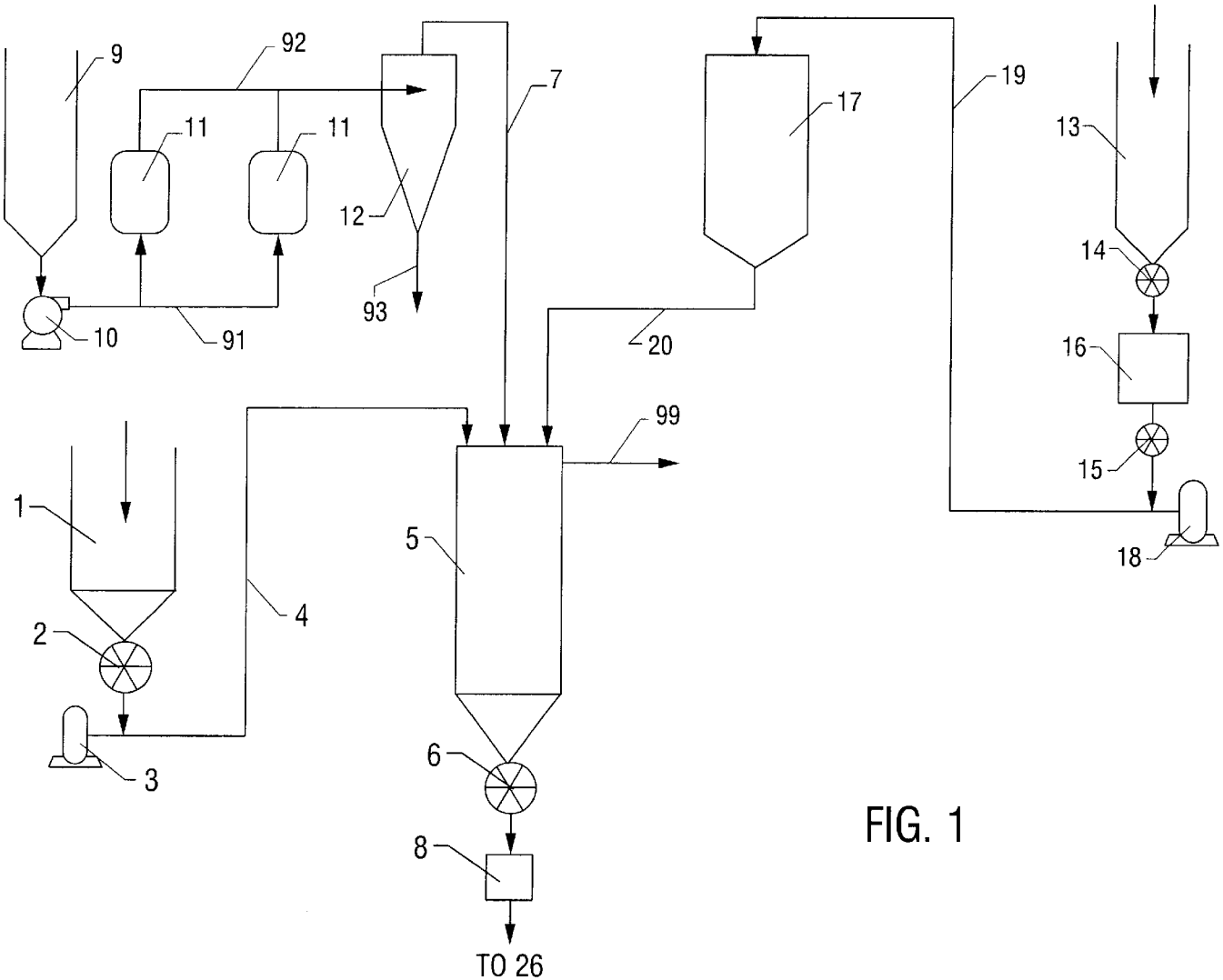
FIG. 1 illustrates used rubber, waste plastics, and used oil feed systems that can be used in accordance with the present invention.

While the invention is susceptible to various modifications and alternative forms, specific embodiments have been shown by way of example in drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DETAILED DESCRIPTION OF PREFERRED EMBODIMENTS

Various embodiments of the present invention are directed to the catalytic conversion of waste organic materials into base organic chemicals, primarily hydrocarbons, from which the organic compounds initially used to make the waste organic materials as well as other organic compounds can be formed. Organic materials are considered waste for the purposes of the present invention, if the material contains at least one organic constituent and if it is desired to convert the organic constituent into hydrocarbons. As such, qualification as a waste organic compound for the purposes of this invention will not depend on the age of the feedstock material or whether the material has, in fact, been used in a previous application.

The base organic chemicals of primary concern that are recovered via the various embodiments of the present invention are lower molecular weight hydrocarbons. In particular, these base organic chemicals are hydrocarbons having less than about fifteen carbon atoms, particularly those having from three carbon atoms to twelve carbon atoms. Of these, particularly preferred hydrocarbons, from the standpoint of the ability to use them as reactants in various synthesis reactions, are those having from four carbon atoms to ten carbon atoms.

For the catalytic conversion process of the present invention, waste organic materials can be any compound capable upon catalytic conversion of forming the aforementioned hydrocarbons. Accordingly, a variety of polymeric and oligomeric compounds, and materials containing same, can be used as sources of the waste organic materials. Indeed, acceptable waste organic materials may not be completely organic in nature.

These waste organic materials may be aromatic species, aliphatic species, species combining aromatic and aliphatic substituents, and combinations thereof. Because of their liberal supply, as previously provided, the waste organic materials may include used rubber (including used tire rubber), waste plastics, and used motor oil and other lubricants.

The present invention can be used with both addition polymers as well as condensation polymers. The various embodiments are particularly useful with addition polymers as the thermocatalytic conversion of these polymers does not yield water as a by-product. The substantial absence of water is desirable because water, if allowed to react with $AlCl_3$ catalyst can result in the generation of corrosive compounds. The presence of such corrosive compounds is most readily ameliorated through the use of corrosive-resistant construction materials. Moreover, the presence of water will result in increased catalyst requirements and, therefore, an increase in the feed of make-up catalyst. Despite these additional problems that can be associated with condensation polymers, the thermocatalytic conversion of condensation polymers is within the capabilities of the present invention.

The products obtained from the thermocatalytic chemical conversion process, primarily hydrocarbons, are recyclable as feedstocks for a broad variety of uses such as gasoline blend stock, naphtha cracker feedstock, refinery reformer operations, and other similar processes. The basic processes for the thermocatalytic conversion of the variety of waste organic materials, including used rubber, waste plastics, used motor oil and lubricants, are for the most part identical. Thermocatalytic conversion is a form of polymer degradation or decomposition. However, unlike depolymerization, catalytic conversion results in hydrocarbon products other than the specific monomers comprising the polymers subjected to the process.

Feed Preparation Section

There are two primary types of feeds for the present invention. They are 1) waste organic materials that are the intended subjects of thermocatalytic conversion; and 2) catalyst. As previously provided, the waste organic materials that are the intended subjects of thermocatalytic conversion may, as desired or as available, contain varying amounts of used rubber and used plastics and may additionally contain typically lesser amounts of used motor oil and lubricants. Each of these feedstock constituents require preparation and feeding systems.

Because there are several excellent used tire shredders/granulator systems available worldwide, this invention does not cover the shredding of used tire rubber. Instead, a specification for shredded used tire rubber, as well as other solid sources of the waste organic materials, has been set as having a maximum dimension of about 2" chunks. Feedstock particulate with a maximum dimension of about ¼" are preferred. While smaller sized feedstock particulate is preferred from a process point of view, the cost of smaller feedstock particulate adds to the cost of processing. Therefore, the process, primarily the isolation valves, have been designed to accommodate commercially available feedstock having a maximum dimension of about 2", primarily to accommodate steel wire of this length that may be embedded in the tire rubber.

Using feedstock with a larger maximum dimension reduces the cost of comminution but increases the reactor residence time necessary to complete chemical conversion of the larger particles to the desired basic organic compounds. As such, it will also tend to negatively impact the hydrocarbon yield obtained in the process, where the hydrocarbon yield can be expressed by dividing, for a particular mass of feedstock, the total mass of hydrocarbon obtained from the process by the corresponding initial mass of feedstock provided to the process. The larger the feedstock size, the longer the reactor residence time, the lower the feedstock chemical conversion rate, and the higher the cost of equipment and production. Thus, the choice of the size of feedstock is a function of its impact on the overall process economics as viewed by the individual processor.

In part, this process improvement (i.e., the ability to utilize a broad range of feedstock sizes) is made possible by the combined use of an isolation feed valve and a stirred reactor which produces an abrasive action among the reactor contents. This abrasive action removes any coating of carbon left on the feedstock during the chemical conversion reaction, facilitating the necessary intimate contact between the catalyst and the feedstock. The stirred reactor preferably has a reactor orbiting mixing screw.

Referring to FIG. 1, used rubber, waste plastics, and used oil and lubricant feed systems that might be used in accordance with an embodiment of the invention in a large scale commercial operation are provided. In FIG. 1, a bulk feed hopper 1 is sized for sufficient capacity to feed shredded rubber to a commercial process. A hopper sized for at least 2 days of operation is preferred. The bulk feed hopper can be in the form of a railcar or hopper truck that can be unloaded directly into the process, or it can be a fixed hopper which commonly handles the shredded rubber and waste plastics feedstock. The feedstock is transferred from hopper 1 into a pneumatically conveying line 4 via star feeder 2. The feed is pneumatically conveyed via blower 3 to feed hopper 5 that is located immediately above the reactor. Air is removed from the hopper via vent 99. The feed is transferred to the reactor through a combination of hardware that precludes a completely open passageway (continuous flow) between the interior of the external feed system and reactor 26. Such is provided by the combination of feeder valve 6 and isolation valve 8. The use of an isolation valve is subsequently disclosed as a means to control material flow between a number of stages in the various embodiments of the present invention. An isolation valve precludes the unrestricted flow of the process stream from one process zone to another zone, either upstream or downstream.

As an example, the feed rate for a typical large scale commercial operation might be 2.5 tons/hour, which is equivalent to approximately 167 cubic feet of shredded tires or waste plastics. Of all the feedstocks, both used rubber and waste plastics have approximately the same high feed rate to the thermocatalytic chemical conversion reactor. To handle the 2.5 ton/hour feed of shredded tires and/or waste plastics using an isolation valve having a tapered recessed cavity in a nominal 12" ball valve, will require about 218 cycle/hour of the isolation valve. Each cycle discharges about 1,130 cubic inches of polymeric feed, or about 22.9 lb. of shredded rubber or waste plastics. Each cycle of the isolation valve requires about 16.5 seconds to fill, rotate 180 degrees, discharge, and return to the fill position. Isolation valve cycle timers may be adjusted by changing the size of the isolation valve and its cavity.

Used oil, waste lubricant, and other liquid organic wastes utilized in the process are preferably filtered prior to addition to the reactor. Filtering can be accomplished off-site. Alternatively, one or more filters 11 can be used to remove any dirt or metallic particles. If this alternative is employed, used oil, lubricants, and other liquid organic wastes are provided to feed tank 9. The contents of feed tank 9 are provided to filters 11 via pump 10 and line 91. After passing through filters 11, the liquids are preferably passed through line 92 to a hydroclone 12 where entrained water is removed. The removed water is fed to the oily sewer via line 93. Removal of the entrained water eliminates its possible reaction with $AlCl_3$ catalyst in the reactor, said reaction generating corrosive hydrogen chloride.

The hydroclone filtered overhead stream can be conveyed by line 7 to feed hopper 5 where it can be sprayed onto the shredded rubber and waste plastics. Spraying the filtered oil onto the shredded rubber and waste plastics is preferred to provide lubrication to the flow into and out of the isolation valve 8. The quantity of used oil that can be expected as feed is considerably less than that for either used rubber or waste plastics and must be determined for each facility site location.

Inasmuch as the collection and granulation of scrap plastics in most locations is not organized, it is assumed that a facility will be provided to accumulate the waste plastics to be processed. Referring to FIG. 1, scrap plastic can be accumulated in scrap plastics hopper 13. As the scrap plastic items are removed at the bottom of the hopper 13, they are passed through feeder-granulator 14 which makes a first pass size reduction before they are pneumatically conveyed to granulator 16. Granulator 16 reduces the waste plastics to a desired maximum dimension. The granulated waste plastic is air conveyed to granulated waste plastics hopper 17 by means of feeder 15, blower 18, and line 19. Preferably, the hopper 17 is elevated sufficiently for gravity flow of the waste plastics granules through line 20 into feed hopper 5.

Inasmuch as it is anticipated that the thermocatalytic chemical conversion reactor is capable of operating at full capacity on any combination of solid feeds, ranging from used rubber only to waste plastics only or any combination thereof, both the waste plastics feed system and the used rubber feed system should be sized to handle the maximum demand of the reactor.

The above described material handling systems are provided as examples only. The components of a material handling system employed to provide feedstock to the thermocatalytic chemical conversion process will inevitably vary, depending on the nature of the waste organic materials to be employed. The described material handling systems, or other systems similarly adapted, can be used in the various embodiments of the present invention to accommodate a variety of sources of acceptable waste organic materials as feeds to a thermocatalytic chemical conversion reactor.

The second type of feed to the process of the invention is catalyst. Desired $AlCl_3$ catalyst levels in the reactor are maintained via the combination of $AlCl_3$ catalyst recycled from process steps downstream of the reactor (i.e., the supplemental reactor) and make-up $AlCl_3$ catalyst. Because of recycle potential, after initial charging, the make-up $AlCl_3$ catalyst feed rate will be very low compared to feed rates for the used rubber, waste plastics, and other feeds. The catalyst make-up feed rate will depend, in part, upon the diligence of the operators and the percentage recovery of recycled catalyst.

Figure 7:
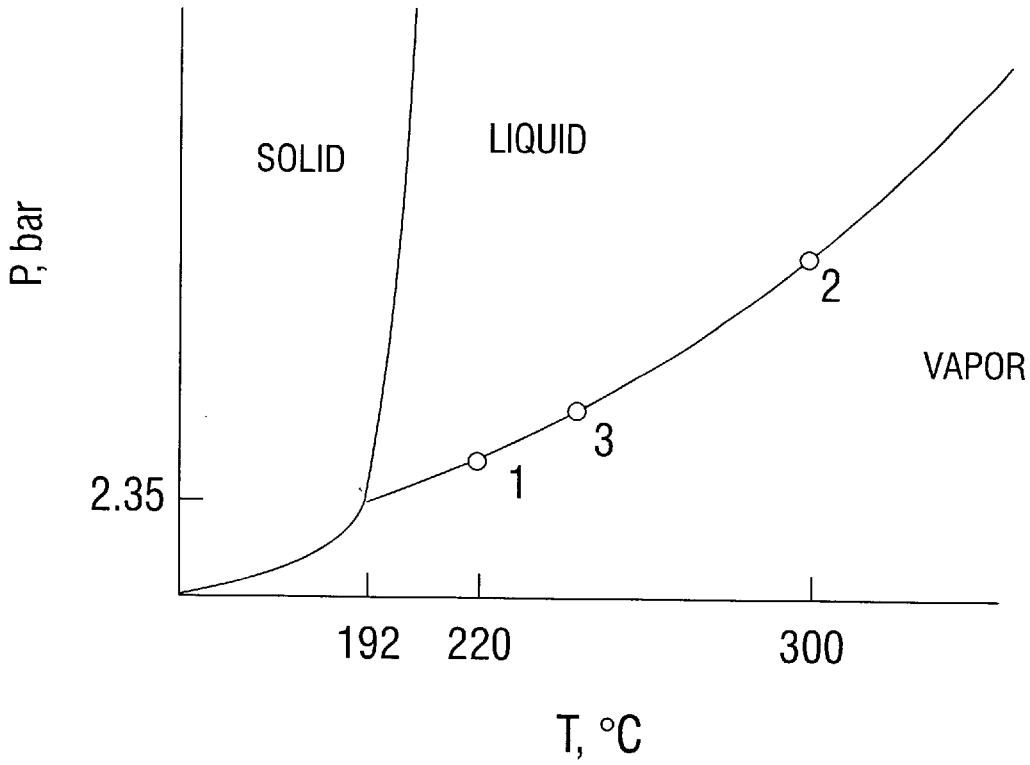
FIG. 7 illustrates a representative phase diagram of the $AlCl_3$ catalyst used in accordance with the present invention.

The catalyst for the thermocatalytic chemical conversion process comprises aluminum trichloride ($AlCl_3$) which is preferably anhydrous and therefore substantially free of entrained moisture. The combination of water vapor and $AlCl_3$ will produce hydrogen chloride, a corrosive chemical and a hazard to the health of the operators and the equipment. Additionally, $AlCl_3$ containing entrained water reduces the effectiveness of the catalyst in performing its thermocatalytic chemical conversion. $AlCl_3$ is a highly hygroscopic sublimable Lewis acid chemical that is white or light yellow material if pure and green or light gray material if impurities are present. FIG. 7 shows a representative pressure-temperature phase diagram with a triple point temperature at 192.5° C. and triple point pressure at 2.35 bar (34.5 psia). Technical literature advises that while the theoretical vapor pressure of $AlCl_3$ varies from 56.7 to 203.3 psia over the 220° to 300° C. temperature range, the actual pressures are substantially lower due to suppression by process conditions.

Figure 2:
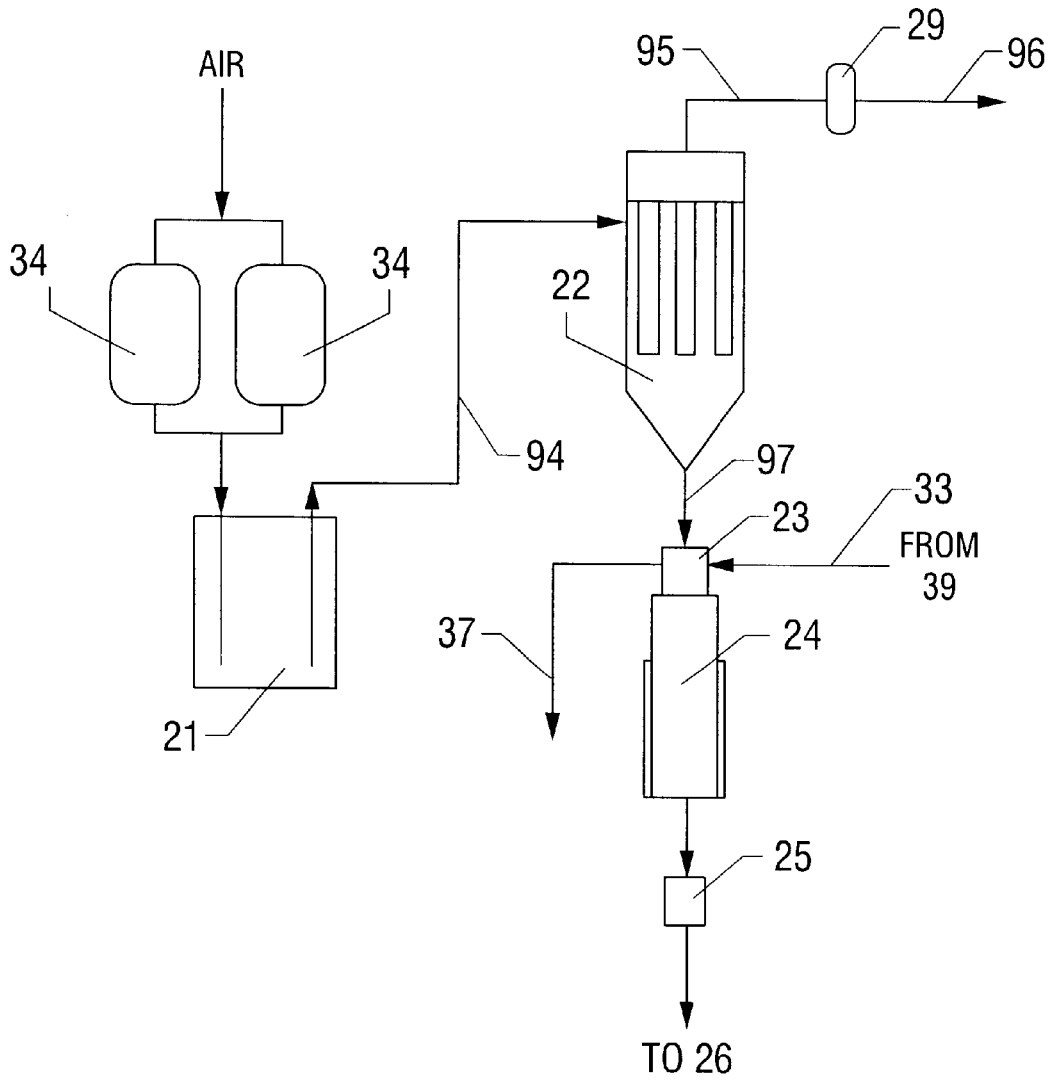
FIG. 2 illustrates a make-up catalyst feed system that can be used in accordance with the present invention.

Referring to FIG. 2, illustrating a make-up catalyst feed system that can be used in accordance with the present invention, catalyst, due to the water concerns, is preferably delivered in moisture proof bags or drums. Drums are preferred from a safety point of view. Drums may be dumped into a catalyst feed hopper. In an effort to minimize exposure to operators and to minimize contamination of the catalyst, a catalyst transfer drum 21 is preferably employed. Catalyst in the drum 21 is conveyed, preferably by vacuum, to bag filter 22 through line 94. The bag filter 22 is preferably mounted above the recycle catalyst condenser 24 and the reactor 26 as shown in FIG. 2. Conveying air is preferably dried in one or more regenerative driers 34 prior to conveying catalyst. Catalyst particles drop to the bottom discharge of bag filter 22, separating from the conveying air. The conveying air exits the top of the bag filter 22 to the atmosphere through line 95, exhaust blower 29, and line 96. Catalyst is removed from bag filter 22 and provided to isolation valve 23 by line 97.

In a typical commercial scale process, on the order of 5% of $AlCl_3$ catalyst can be lost or deactivated. Based on 16.5 seconds/cycle, isolation valve 23 having a 6.25" diameter ball valve can transfer about 1.2 lbs. of solid catalyst per cycle to the recycle catalyst condenser 24. Recovered and recycled additional vaporized $AlCl_3$ catalyst and hydrocarbons from the supplemental reactor 39 will enter the recycle condenser 24 at a rate of about 4,750 lbs./hour via line 33. The additional vaporized $AlCl_3$ catalyst from supplemental reactor 39 will be condensed, mixing with make-up $AlCl_3$ catalyst for a total of about 5000 lbs./hr of $AlCl_3$ catalyst through the recycle catalyst condenser 24. Based on a ratio of 1:1 volume of catalyst to solid feed and 16.5 seconds/cycle (218 cycles/hour), isolation valve 25 which in this embodiment is comprised of a 12 inch diameter ball valve will transfer about 23 lbs. of liquid $AlCl_3$ catalyst per cycle to the reactor.

In certain embodiments, $AlCl_3$ is used as the sole catalyst component, while in other embodiments cocatalysts, such as $MgCl_2$, can be used. The reactive steps in the process are conducted at temperatures sufficient to maintain $AlCl_3$ as a fluid. Preferably, the reactive steps are conducted at temperatures ranging from about 200° to about 350° C. Temperatures greater than about 350° C., while attainable, are generally detrimental to the quality of any recovered carbon black and therefore are not preferred. The use of $AlCl_3$ alone as a catalyst facilitates catalyst recovery and recycle while affording one the ability to obtain a hydrocarbon product high in desirable hydrocarbons, such as isobutane and isooctane. In contrast to a catalyst system consisting solely of $AlCl_3$, different dual catalyst systems using cocatalysts such as $MgCl_2$, $BaCl_2$, LiCl, and NaCl, will affect the conversion and product composition differently. Each of these dual catalyst systems also requires an added catalyst blending step and significant amounts of cocatalyst make-up.

$AlCl_3$ catalyst recycle is made possible because the $AlCl_3$ catalyst can be separated from the carbon black and residues by vaporization and condensation, condensation encompassing both a phase change from vapor to liquid as well as a phase change from vapor to solid. The separation process is described subsequently. Briefly however, the basis for recovery of $AlCl_3$ are illustrated in FIG. 7, which shows a representative $AlCl_3$ temperature and pressure phase diagram.

Thermocatalytic Reaction Section

The preferred concept of the present invention is to provide a reactor having an annual capacity on the order of 20,000 tons/year of feedstock. Preferably, the reactor would be mobile and could be combined with other reactors in a modular design. Generally, this preference is because of the cost of transportation for large scale designs and because used tires and waste plastics have been accumulated in stockpiles in various geographic locations. To save transportation costs, the broadest concept of the invention is to provide skid-mounted equipment to permit the relocation of the process from stockpile to stockpile.

According to this preferred concept, the capacity of a single line is based primarily on the economics of the operation and the ease of relocating to other operating sites. Process architectures other than the mobile modular design may be used.

Figure 3:
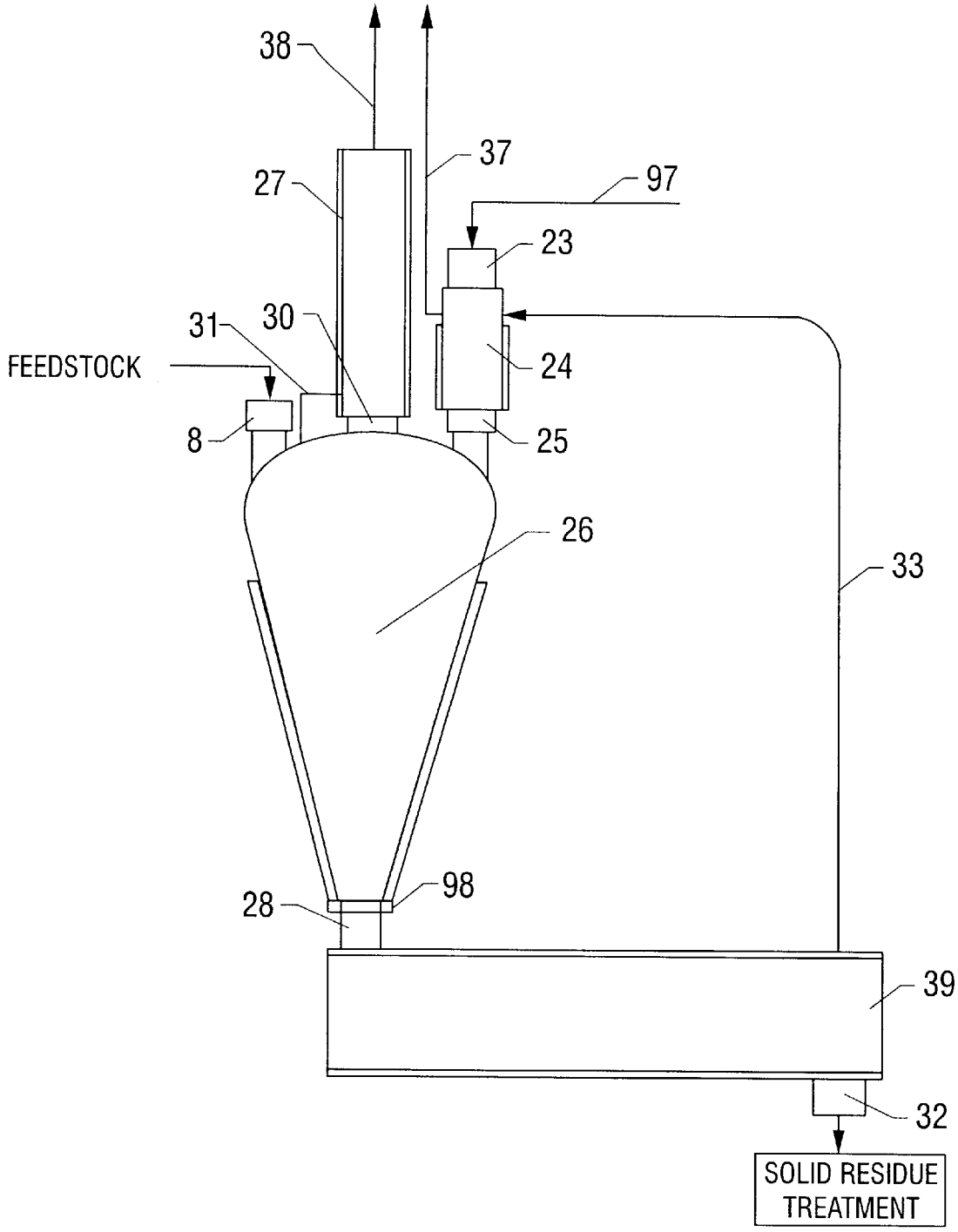
FIG. 3 illustrates the process reaction section of an embodiment of the present invention.

Referring to FIG. 3, hot oil circulation is used to control and maintain the temperatures of reactor 26, supplemental reactor 39, recycle catalyst condenser 24, and reflux condenser 27. Because the operating temperature of the reflux condenser 27 is less than the operating temperature of the recycle catalyst condenser 24, which in turn is less than that of the supplemental reactor 39 and the reactor 26, a preferred embodiment of the process employs a hot oil system that minimizes energy consumption. Preferably, a single hot oil circulating system is employed. Depending upon the composition of the waste organic material fed to the reactor, the thermocatalytic reaction will range from mildly endothermic (energy input required) to moderately exothermic (energy removal required). During start-up of the reactor, hot oil, at a temperature close to the intended reactor operating temperature, is circulated through the jacketing of reactor 26 to obtain the desired temperature.

Experimentation has shown that the thermocatalytic conversion reaction proceeds much more rapidly when the $AlCl_3$ catalyst is a fluid, either in a molten liquid or gaseous state, than when the catalyst is solid and granular. When the $AlCl_3$ catalyst exists as a fluid, increased conversion rates are achieved because the catalyst can more easily provide intimate contact with the surface of the feedstock. Additionally, heat transfer and material flow are more efficient when the $AlCl_3$ catalyst exists primarily as a fluid. As such, the reactor temperatures and pressures are advantageously selected such that the $AlCl_3$ is preferably maintained as a fluid. A representative phase diagram for $AlCl_3$ is provided as FIG. 7. Reactor temperatures, accordingly, are preferably within the range of about 200° to about 350° C. Pressures are maintained in the range of about 0.05 bar to about 150 bar.

The ratio of volume of catalyst to volume of feedstock in the reactor 26 ranges from about 0.5:1 to about 5:1. Ratios of volume of catalyst to volume of feedstock from 1:1 to as high as 2:1 are preferably maintained. These high ratios result in high conversion rates. Ratios less than 1:1 result in slower reaction rates and lower capacities. Ratios higher that 2:1 are generally cost prohibitive under current economics.

During initial start-up, preferably about 75% of the catalyst needed for operation is added to the reactor 26. The catalyst can be, and preferably is, provided from a recycle catalyst condenser 24 that contains both recycled $AlCl_3$ catalyst and, as necessary, make-up catalyst. Mixing of the reaction mass within the reactor 26 is important to heat transfer, temperature control, and conversion. As such, the reactor 26 is preferably equipped with a means of mixing the contents. Preferably, the reactor 26 is equipped with an intensive reactor orbiting mixing screw to facilitate the mixing of the reactor contents throughout the process. Such a reactor is manufactured by Charles Roth & Son Company.

The high catalyst ratios, coupled with the intensive mixing of the reactor stirrer, results in the near immediate chemical conversion of organic particulate feed to hydrocarbon gases. These hydrocarbon gases are removed from the reactor 26 for recovery downstream. The high catalyst ratios, coupled with the intensive mixing of the reactor screw, are also what allows for the use of particulates having a maximum dimension in the range of about 2". The very rapid chemical conversion reaction results in a very short reactor residence time and high throughput rates. Experimentation has confirmed that the thermocatalytic chemical conversion reaction of used tire rubber is exothermic, said released heat being on the order of 3000 J/Kg.

During the initial charging of the reactor 26 with catalyst, the mixing screw or other mixing means should be, and preferably is, operated at low rpm's. Subsequently, feed of granulated or shredded rubber, plastics, or other feedstock of waste organic materials may be started at normal operating rates. Simultaneously, the speed of rotation of the mixing screw or other mixing means can be increased up to normal operating rates. The action of the preferred orbiting mixing screw will simultaneously mix the reaction mass horizontally and from bottom to top.

Referring to FIG. 3, as well as FIG. 1, the feedstock is fed into the reactor 26 via isolation valve 8. As described earlier, to process 20,000 tons/year of feed, a 12" isolation valve, feeding about 23 lbs. of feed to the reactor every 16.5 seconds is required. Continuous supply of feedstock is provided while the temperature of the reactor 26 is simultaneously adjusted to the desired operating temperature, which will preferably be in the range of about 200° to about 350° C. and more preferably in the range of about 220° to about 325° C.

The yield of the system and the composition of the hydrocarbon product is dependent on the reaction temperature. The rate of reaction of the system will also be directly proportional to the catalyst to feedstock ratio and inversely proportional to the size of feedstock particles.

An overhead portion of the reactor 26 containing vaporized hydrocarbons as well as vaporized $AlCl_3$ is removed from the reactor 26. The overhead portion generally will contain the most significant portion of the base organic compounds—significantly hydrocarbons—produced in the reactor 26. Because the catalyst is extremely aggressive, it is desirable to immediately convey the gaseous hydrocarbons from the reactor 26 before they are further chemically converted. In various embodiments, removal of the overhead portion can be aided through the use of a vacuum or a purge gas. The purge gas can be introduced into the reactor by numerous means, including through a port drilled into the edge of a connecting flange 98 located between the base of reactor 26 and isolation valve 28. The purge gas, acting as a carrier and blanketing gas, may comprise, by way of example only, hydrogen, methane, nitrogen, helium, natural gas, or combinations thereof.

The purge gas also assists in suppressing competing side reactions. It must be recognized that there are several nearly simultaneous competing reactions, not all of which have been identified and quantified, that have a profound effect on the final hydrocarbon composition. In part, suppression is achieved through the prompt removal of the generated base hydrocarbons from reactor 26. Additionally, however, the purge gas, depending on its composition and as known to those of ordinary skill in the art, can provide hydrogen for hydrogenation reactions to mitigate dehydrogenation side reactions. If unchecked, the dehydrogenating side reactions will produce free carbon, diminishing the yield of desirable hydrocarbon products.

The thermocatalytic chemical conversion process can be operated in three different modes. The products obtained for each mode of operation have properties specific to that mode. The vapor pressure of $AlCl_3$ is very significant to each of these operating modes. The three individual modes of reactor operation are characterized by thermocatalytic chemical conversion under 1) low reactor pressure; 2) partial vacuum; and 3) high reactor pressure. While mode 2 is referred to in the context of "partial vacuum" conditions, it should be understood the conditions of mode 2 operation still involve positive pressures. Pressures are generally maintained in the following ranges for the modes:

TABLE 1

| | | |
|---|---|---|
| Mode 1 | 1.2–5.0 bar | (17.6–73.5 psia) |
| Mode 2 | 0.05–0.25 bar | (0.73–3.67 psia) |
| Mode 3 | 5.0–150 bar | (73.5–2200 psia) |

Purge gas can be employed in each of three modes. However, the purge gas is particularly important in modes 1 and 3 where it is used to maintain the necessary pressures and where its presence helps to exclude oxygen from the reactor 26.

Liquid hydrocarbons, in addition to solid residues, are the major product obtained from the mode 1 operation of the thermocatalytic chemical conversion reactor. Mode 2 operation results in the production of unsaturated hydrocarbons as well as saturated hydrocarbons. Mode 3 operation again results in a production favoring saturated hydrocarbons obtained via a concurrent hydrogenation reaction. The high pressures promote hydrogenation of any free carbon created back to its originally intended molecular structure.

Mode 1 operation in a pressure range from 1.2 to 5 bar, is designed, in part, to prevent the leakage of air into the reactor and the concomitant production of unwanted carbon dioxide. A competing dehydrogenation reaction occurs at these conditions, separating hydrogen from low molecular weight hydrocarbons and transferring it to unsaturated hydrocarbons, causing the formation of saturated hydrocarbons and the formation of free carbon. These dehydrogenation and hydrogenation reactions continue until all hydrocarbons in the reactor are saturated. Because of these competing reactions the overall yield of hydrocarbon products is reduced.

Mode 2 of reactor operation features operation at partial pressures in the 0.05 to 0.25 bar pressure range. This "partial vacuum" operation and the pressure of purge gas results in the removal of the hydrocarbons from the reactive environment before further chemical modification. This mode of operation produces a mixture primarily of olefins and alkanes.

Mode 3 operation is at positive pressures ranging from 5 bar to as high as 150 bar. The objective of mode 3 operation is to minimize the dehydrogenation of unsaturated hydrocarbons. Dehydrogenation reactions, such as those that occur in mode 1 operation, decrease the yield of hydrocarbons and increase free carbon production. Higher 8 pressures, in this range, are necessary to promote concurrent hydrogenation of newly formed unsaturated hydrocarbons to saturated products countering the further dehydrogenation of unsaturated products and the formation of free carbon. Mode 3 requires the presence of hydrogen donor molecules, which attach to the unsaturated hydrocarbons as they are formed, precluding the production of free carbon. The most convenient source of hydrogen donor molecules is the purge gas. Acceptable purge gases, such as hydrogen and methane, enter the reactor 26 from connecting flange 98. The gas percolates up through the stirred reactor bed and then exits the reactor 26 simultaneously to supplemental reactor 39 and a hydrocarbon product condensing zone. The yield of saturated hydrocarbons is maximized in mode 3 operation. Accordingly, mode 3 operation results in an improvement in the process economics over those of mode 1.

Mode 3 operation also requires the presence of a cocatalyst. $MgCl_2$ is the preferred cocatalyst. Other acceptable cocatalysts include chloride salts or mixed chloride salts of alkali and alkaline earth metals, such as $BaCl_2$, LiCl, and NaCl. The cocatalyst is preferably added to the reactor 26 via recycle catalyst condenser 24. Unlike the $AlCl_3$ catalyst, the cocatalyst added to the reactor is primarily, if not solely, comprised of make-up catalyst as the cocatalyst is not recycled in the process. The ratio of $AlCl_3$ catalyst to $MgCl_2$ cocatalyst in the reactor is maintained between 1:1 to 1:2.5, preferably near a mole ratio of 1:2.

The presence of vaporized $AlCl_3$ catalyst in the reactor overhead portion is due to the fact that in the reactor 26, the $AlCl_3$ catalyst will develop a vapor pressure sufficient to exit the reactor 26 with the flow of the chemically converted hydrocarbon stream. The presence of the vaporized $AlCl_3$ in the overhead portion is problematic for two reasons: 1) it is a contaminant with regards to the desired recovery of hydrocarbons and 2) any $AlCl_3$ removed from the reactor must eventually be replenished. For these reasons, in some embodiments it is desirable to return a portion, preferably essentially all, of the $AlCl_3$ to the reactor 26. To accomplish this, the overhead portion is provided to a condensing zone.

In certain such embodiments, the condensing zone may be comprised of a reflux condenser 27. Such an arrangement is especially advantageous for mode 1 and mode 3 operation, but it also may be necessary to optimize mode 2 operation. The reflux condenser 27 is mounted in the hydrocarbon product discharge line above the reactor 26 and discharge port 30. The reflux condenser has two purposes: (1) to remove vaporized $AlCl_3$ from the overhead stream and return it to the reactor 26; and (2) to return low volatility hydrocarbons to the reactor 26 for additional processing. In the reflux condenser 27, $AlCl_3$ vapor leaving the reactor 26 via the hydrocarbon product discharge port 30 is returned to a non-gaseous state such that it is removed from the high volatility hydrocarbons of the overhead portion by condensing, commonly as solid particles, on the walls of the reflux condenser 27. Also in the reflux condenser 27, a first fraction of hydrocarbons, those having a vapor pressure below a desired value, can be removed via condensation. The desired vapor pressure value can be controlled, as known to those of ordinary skill in the art, by varying the operating conditions, primarily temperature, of the reflux condenser 27. A second fraction of hydrocarbons having a vapor pressure above the desired value will remain in the vapor phase. Thus, one can tailor the composition of the hydrocarbon product. The reflux condenser 27 is set to operate in a temperature range sufficient to cause condensation of $AlCl_3$ and to provide the desired composition of the overhead hydrocarbon product. The operating temperature range normally will be from about 50° C. to about 176° C. (or about 120° F. to about 350° F.).

In the reflux condenser 27, the condensed first fraction of hydrocarbons will flush condensed $AlCl_3$ particles from the walls of the reflux condenser 27 back into the reactor 26 where they will continue to participate in further thermocatalytic chemical conversion reactions. The return flow of condensed first fraction of hydrocarbons and/or condensed first fraction of hydrocarbons in combination with condensed $AlCl_3$ from the reflux condenser 27, can be channeled back into the reactor 26 via hydrocarbon discharge port 30, or through another port. Preferably, the return flow is through hydrocarbon discharge port 30. The design of the reflux condenser 27 is not critical and can be, for example, a simple vertical air cooled system or a vertical internal wiped film system. Additionally, in certain embodiments the condensing zone may be comprised of both a reflux condenser 27 as well as a catalyst condenser placed between discharge port 30 and reflux condenser 27. Such an arrangement can be used to achieve a more discrete fractionization of the hydrocarbon product.

The non-condensed vapors of the second fraction of hydrocarbons will exit the reflux condenser 27 via line 38 and will be condensed as liquid product downstream. In various embodiments, the entire composition of the second fraction of hydrocarbons will not be condensed simultaneously. For example, in various embodiments, the second fraction of hydrocarbons might be subjected to various fractionation processes in which certain hydrocarbons, such as propane, are preferentially removed.

In mode 2 operation, coolant flow to the reflux condenser 27 is terminated, allowing the hydrocarbon and catalyst vapor to pass through to the downstream recovery facilities. The vacuum source is downstream of line 38.

Figure 6:
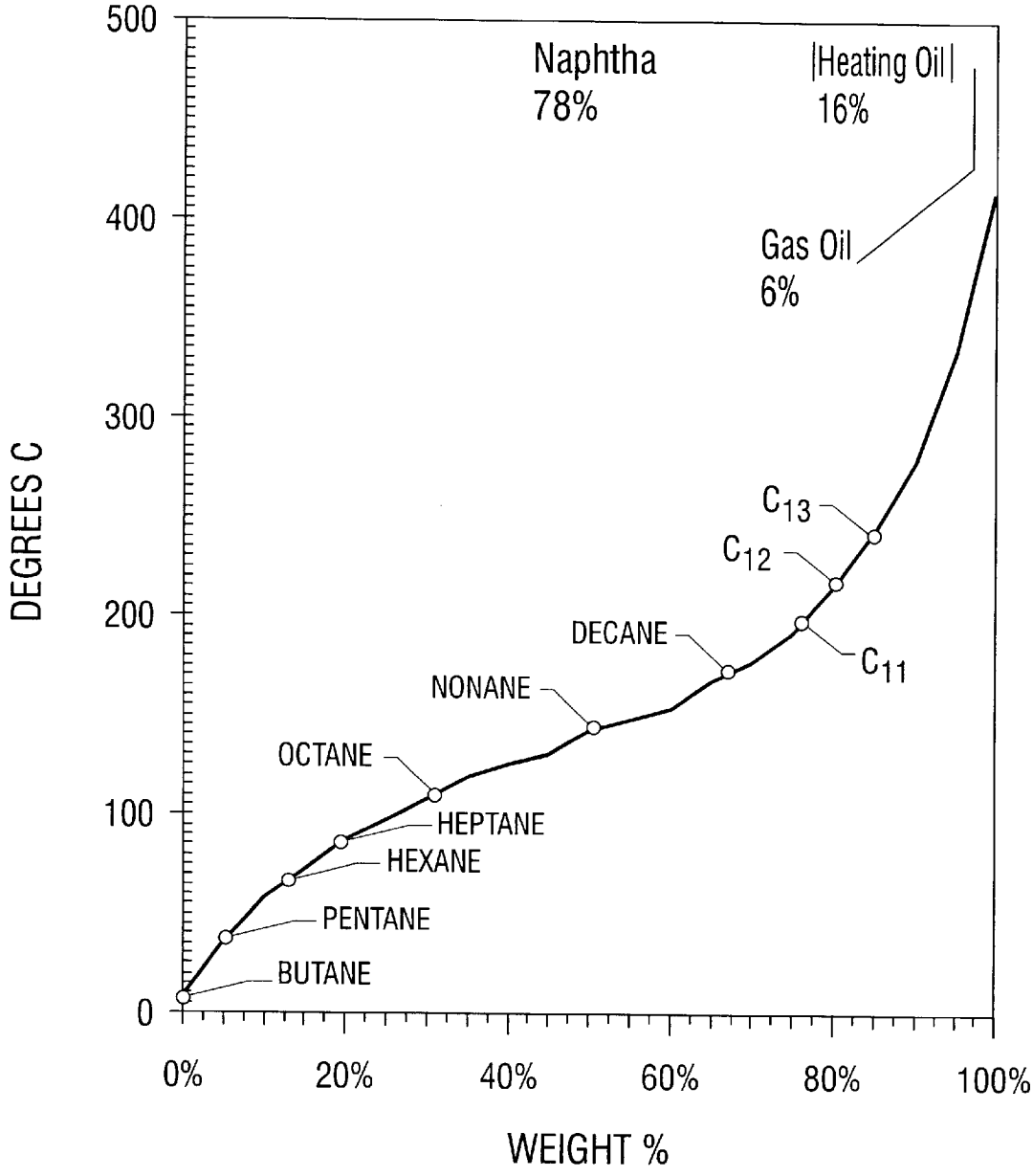
FIG. 6 is the simulated distillation curve for a process run in accordance with the present invention.

As previously indicated, the reflux condenser 27 will be maintained at different temperatures depending on the desired hydrocarbon end products. The higher the temperature, the greater the recovery of higher molecular weight hydrocarbons. This is illustrated in FIG. 6, which is a plot of simulated distillation of a mode 2 run. The composition of the hydrocarbon product influences its market value. Table 2 gives the composition of the mode 2 run illustrated in FIG. 6 by carbon number and type.

TABLE 2

Composition of Hydrocarbon Product, Weight Percent

| Carbon No. | n-Paraffins | iso-Paraffins | Olefins | Naphthenes | Aromatics |
|---|---|---|---|---|---|
| C1 | 0 | 0 | 0 | 0 | 0 |
| C2 | 0 | 0 | 0 | 0 | 0 |
| C3 | 0.82 | 0 | 0 | 0 | 0 |
| C4 | 4.24 | 23.58 | 1.20 | 0 | 0 |
| C5 | 0.95 | 23.40 | 1.42 | 0.22 | 0 |
| C6 | 0.21 | 30.35 | 0.66 | 2.06 | 0.40 |
| C7 | 0.06 | 4.46 | 0.41 | 1.24 | 0.24 |
| C8 | 0.05 | 2.15 | 0.11 | 0.87 | 0.04 |
| C9 | 0.07 | 0.10 | 0 | 0.12 | 0.20 |
| C10 | 0 | 0 | 0.09 | 0 | 0.18 |
| C11 | 0 | 0 | 0 | 0 | 0 |
| C12 | 0 | 0 | 0 | 0 | 0 |

From FIG. 6 and Table 2, it can be seen that approximately 78% of the hydrocarbon product produced was naphtha while the remaining 22% was lower-value heating and gas oils. By adjusting the temperature of the reflux condenser 27, to condense hydrocarbons having boiling points greater than approximately 176° C., the heavier, lower value oils will condense and be returned to the reactor 26 where they will again be subjected to additional thermocatalytic chemical conversion to lighter, higher value hydrocarbons. Such a modification will necessarily improve the yield of naphtha and the overall process economics.

In a preferred embodiment the reaction section equipment is capable of operating in all three modes of operation. In such a preferred embodiment, discharge port 30 is preferably an isolation valve. The isolation valve is required to generate the high pressures of mode 3 operation. To accommodate mode 2 operation in such a preferred embodiment, a bypass line 31 is provided between reactor 26 and reflux condenser 27. The bypass line 31 is valved so that it can be closed for operations at higher pressures. If mode 3 operation is not contemplated, then discharge port 30 does not have to be an isolation valve. Indeed, if mode 3 operation is not contemplated, it is preferred that discharge port 30 will be an open passageway or a valve that will generally, if not exclusively, be maintained in the open position such that removal of the reactor overhead portion is preferably continuous. In such an arrangement, bypass line 31 is not required but may still be included.

An extremely important feature of the process is the recovery of $AlCl_3$ catalyst downstream of the reactor 26. FIG. 3 illustrates the process flow. After removal of the overhead portion, the stirred reactor 26, operating in any of the three described modes, will contain a mixture of purge gas, unreacted feedstock, vaporized hydrocarbon product, and catalyst, including active $AlCl_3$ catalyst as well as any cocatalyst that has been used. Depending on the composition of the initial feedstock, the reactor 26 may also contain carbon black, fragments of reinforcing steel wire, and inert fillers (such as titanium dioxide). Any hydrocarbon product will generally be present at low levels. This remaining mixture, or reactor discharge, is periodically removed from the reactor 26 through an isolation valve 28 and provided to supplemental reactor 39 where additional vaporized hydrocarbon and additional vaporized $AlCl_3$ catalyst is generated.

Once in the supplemental reactor 39, the reactor discharge is heated to, or alternatively maintained at, a nominal temperature ranging from about 220° to about 350° C., preferably from about 275° to about 325° C. Typically, the reactor discharge is heated or maintained at temperature by hot oil circulating through the jacket of the supplemental reactor 39. FIG. 7 indicates how the combination of temperature and pressure will affect the physical state of the $AlCl_3$ catalyst in 1) the reactor 26, 2) the supplemental reactor 39, and 3) in the recycle catalyst condenser 24. Those temperatures are shown in FIG. 7 as being on the boundary between the vapor and liquid phase of a representative $AlCl_3$ phase diagram. Although the theoretical vapor pressure of $AlCl_3$ is several hundred psia at these temperatures, the actual vapor pressure in the supplemental reactor 39 is much lower, suppressed by process conditions.

When the supplemental reactor 39 is operating at temperatures approaching about 350° C., sufficient vapor pressures will be generated to convey $AlCl_3$ catalyst vapor to the recycle catalyst condenser 24 through line 33. Conversely, when the reactor 26 is operating at lower temperatures, heating of the supplemental reactor 39 will be necessary. In any event, the temperature needed to condense the $AlCl_3$ catalyst vapor in the recycle catalyst condenser 24 will remain essentially the same regardless of the temperatures of the reactor 26 and the supplemental reactor 39. Regardless of the means employed to maintain the reactor discharge at the desired temperature, the thermocatalytic chemical conversion reaction will continue in supplemental reactor 39, converting remaining unreacted feedstocks to additional hydrocarbons and simultaneously vaporizing these additional hydrocarbons and completing the vaporization of any residual $AlCl_3$. The vaporization of the residual $AlCl_3$ catalyst and the generation of the additional vaporized hydrocarbons result in a higher gas pressure in the supplemental reactor 39. Accordingly, this latter phase of the process is achieved at pressures typically in the range of 15 to 250 psi. The cocatalyst, having a much higher melting point, will generally not be vaporized and will therefore remain with the residue and be discharged from the supplemental reactor 39 for solids recovery and separation.

A variety of vessels and other apparatus can be used as the supplemental reactor 39. The primary characteristic of an acceptable supplemental reactor 39 are 1) the ability to either maintain the heat of its contents or to provide heat to its contents, 2) convey the reactor discharge from one end (that end proximal to isolation valve 28) to the other end (discharge end), and 3) a sufficient length, given the size of the other components in the process, so that the conversion of residual feedstock to additional vaporized hydrocarbons and the vaporization of the residual $AlCl_3$ catalyst can occur. A particularly preferred supplemental reactor is a thermascrew separator, such as manufactured by Hoskawa/Bepex. In this preferred supplemental reactor, heating is also achieved by the countercurrent flow of hot oil through the shaft and elements of the thermascrew separator.

As shown in FIG. 3 and previously indicated, the gaseous mixture of additional vaporized $AlCl_3$ catalyst and additional vaporized hydrocarbons will exit the supplemental reactor 39, preferably via a heated conduit 33, and be channeled to recycle catalyst condenser 24. The driving force for the flow is the pressure differential between the gaseous pressure in the supplemental reactor 39 and the point of condensation of the $AlCl_3$ in the recycle catalyst condenser 24. Additional vaporized hydrocarbons produced in the supplemental reactor 39 flow with the vaporized residual $AlCl_3$ catalyst through the same conduit 33 and are separated in the recycle catalyst condenser 24. This separation is achieved by maintaining the recycle catalyst condenser 24 at a temperature such that a portion, preferably essentially all, of the vaporized residual $AlCl_3$ is condensed while a portion, preferably a major portion and even more preferably essentially all, of the additional vaporized hydrocarbons is maintained in the vapor state. This portion of additional vaporized hydrocarbons is diverted via line 37 where it can be combined with hydrocarbon product flow 38 en route to downstream hydrocarbon product recovery. It is evident from the foregoing that the additional vaporized hydrocarbon flowing into the recycle catalyst condenser 24 may be subjected to various fractionation and separation procedures to divide the hydrocarbon into various fractions. Heavy fractions can thereby, as desired, be returned to the reactor 26 for further conversion into smaller hydrocarbon molecules.

In the recycle catalyst condenser 24, that portion of the additional vaporized $AlCl_3$ catalyst that is now-condensed is periodically returned to the reactor 26 as necessary to maintain the proper ratio of catalyst to feedstock. Preferably, the $AlCl_3$ catalyst is returned via an isolation valve 25. During the previous stages, there will have been various minor $AlCl_3$ catalyst losses through, for example, reaction with transient water vapor. These, and other potential losses are made up by adding additional $AlCl_3$ catalyst to the reactor 26.

Addition of make-up $AlCl_3$ catalyst to reactor 26, as well as addition of any cocatalyst, is preferably via an isolation valve. Preferably, the make-up catalyst is added via an isolation valve 23 to the now-condensed additional vaporized $AlCl_3$ catalyst in recycle catalyst condenser 24. The combination can then be returned to the reactor 26, again preferably through isolation valve 25. The heat of the thermocatalytic conversion reaction will bring the make-up catalyst to reaction temperature.

Solids Recovery and Separation

Figure 5:
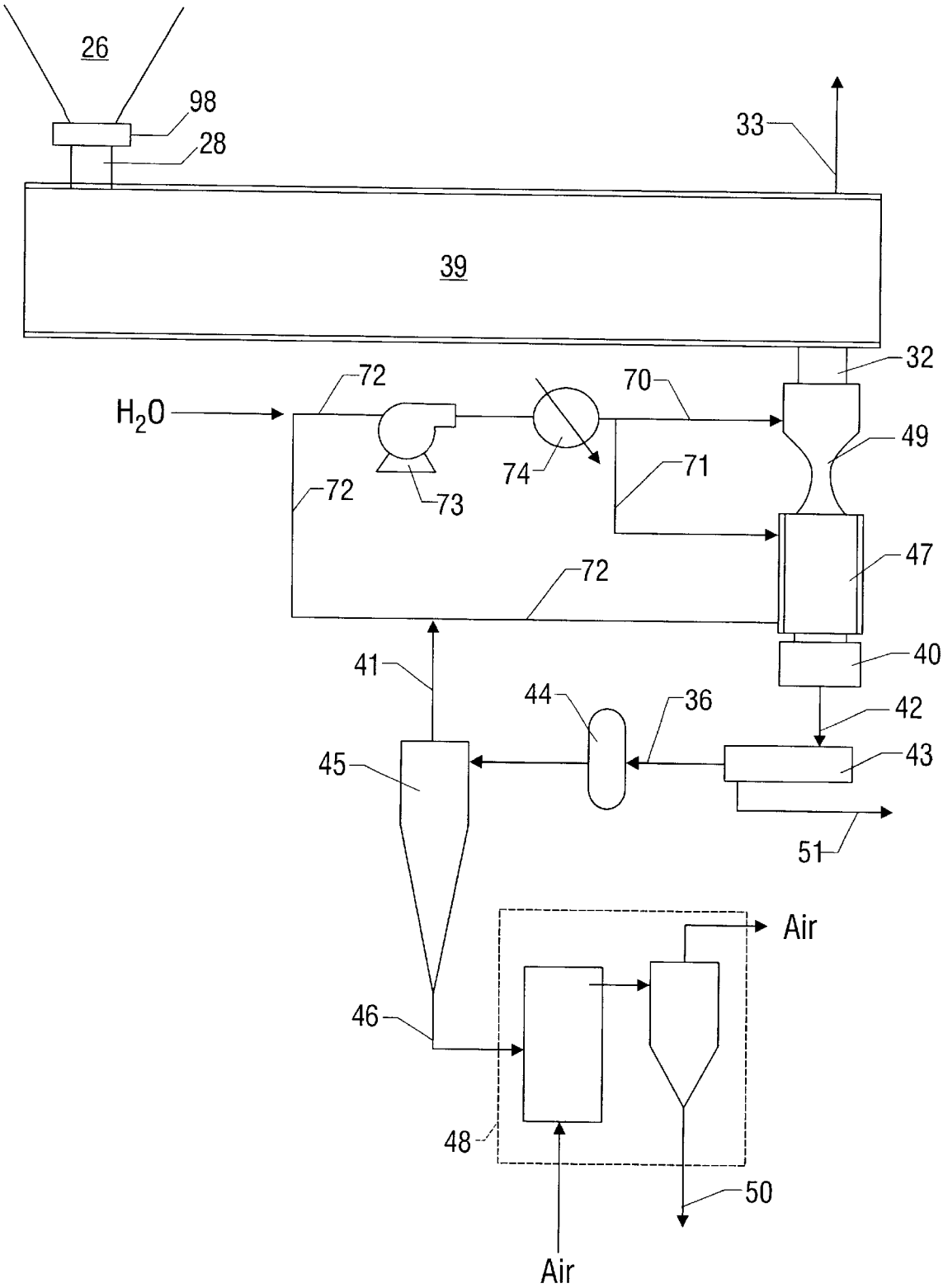
FIG. 5 illustrates the process flow of a solid residue system that can be used in accordance with an embodiment of the present invention.

The remaining residue in the supplemental reactor 39, typically containing carbon black, pigments, fillers, steel wire, and cocatalyst (when mode 3 operation employed), is removed from the supplemental reactor 39, preferably through isolation valve 32. The removed residue is preferably subjected to solid residue treatment to recover carbon black and to separate any steel fragments that may have passed through the process with the carbon black. The specific process used in not important for other aspects of the invention, and any of the known commercial processes for recovering carbon black can be used. Such processes would include that illustrated in FIG. 5 and described below.

The solids leaving the supplemental reactor 39 via isolation valve 32 may be as hot as 350° C. (662° F.) and under a pressure as high as 200 psi. Immediately upon exiting isolation valve 32 the hot mass will be flushed with copious quantities of chilled water, via line 70, as it passes through conveying injector 49. Backflow of the slurry is prevented by isolation valve 32. The slurry of solids and water will immediately enter jacketed heat exchanger 47, cooled by additional chilled water via line 71, such that the temperature of the slurry exiting the heat exchanger 47 is near ambient temperature. Water from the heat exchanger 47 is recycled to both the conveying injector 49 and heat exchanger 47 through line 72, pump 73 and chiller 74. Make-up water can be added, such as at line 72, as necessary. The cooled slurry will pass through a grate magnetic separator 40 where residual strands of steel wire in the solids residue will be retained and later removed. The slurry of solid particulate will flow via line 42 to flotation separator 43 wherein smaller carbon black particles (e.g., 325 mesh) will be separated from the oversize carbon black, cocatalyst residue, and solid inerts. The screened oversized carbon black and cocatalyst residue can be removed via line 51. The cocatalyst residue will settle in flotation separator 43 and will be conveyed via line 51 offsite where recovery of the various heavy residues can be considered.

The slurry overflow from flotation separator 43 flows via line 36 to pump 44 where the linear velocity of the slurry will be sufficient that the free water is separated from the carbon black in hydroclone 45. The damp carbon black underflow is conveyed via line 46 to flash drier 48. The water from hydroclone 45 passes overhead, via line 41, to join line 72, which is recycled via pump 73 and chiller 74 to conveying injector 49 and heat exchanger 47. Hot air is circulated through flash drier 48 removing the residual moisture from the carbon black. The carbon black leaves the flash drier via line 50 and is packaged as carbon black product. If the carbon black requires additional comminution, a mill, such as a Sturtevant jet mill, can be employed. The mill can be inserted in line 36.

The dried carbon black product is recovered, analyzed, and packaged. The analysis will determine the characteristics of the product and result in the assignment of a carbon black grade to the product. Throughout the above solid residue treatment process, the temperature has been kept below 350° C., a temperature above which carbon black loses its activity and reinforcing properties. Once these properties are lost, the value of the carbon black is substantially reduced. The grade of carbon black will determine what applications it is suitable for, and hence its approximate economic value.

The need to be able to isolate the process steps of the thermocatalytic conversion process from upstream and downstream conditions is an important aspect of the various embodiments of the present invention. This has lead, as disclosed, to the use of isolation valves that control the flow from step to step. FIG. 3 shows the location of five isolation valves used in the process. They are:

1) Controlling the flow of feedstocks into the reactor 26.
2) Controlling the flow from reactor 26 to the supplemental reactor 39.
3) Controlling the flow from the supplemental reactor 39 to the solid residue treatment section.
4) Controlling the flow of make-up catalyst to the recycle catalyst condenser.

5) Controlling the flow from the recycle catalyst condenser 24 to reactor 26.

Figure 4:
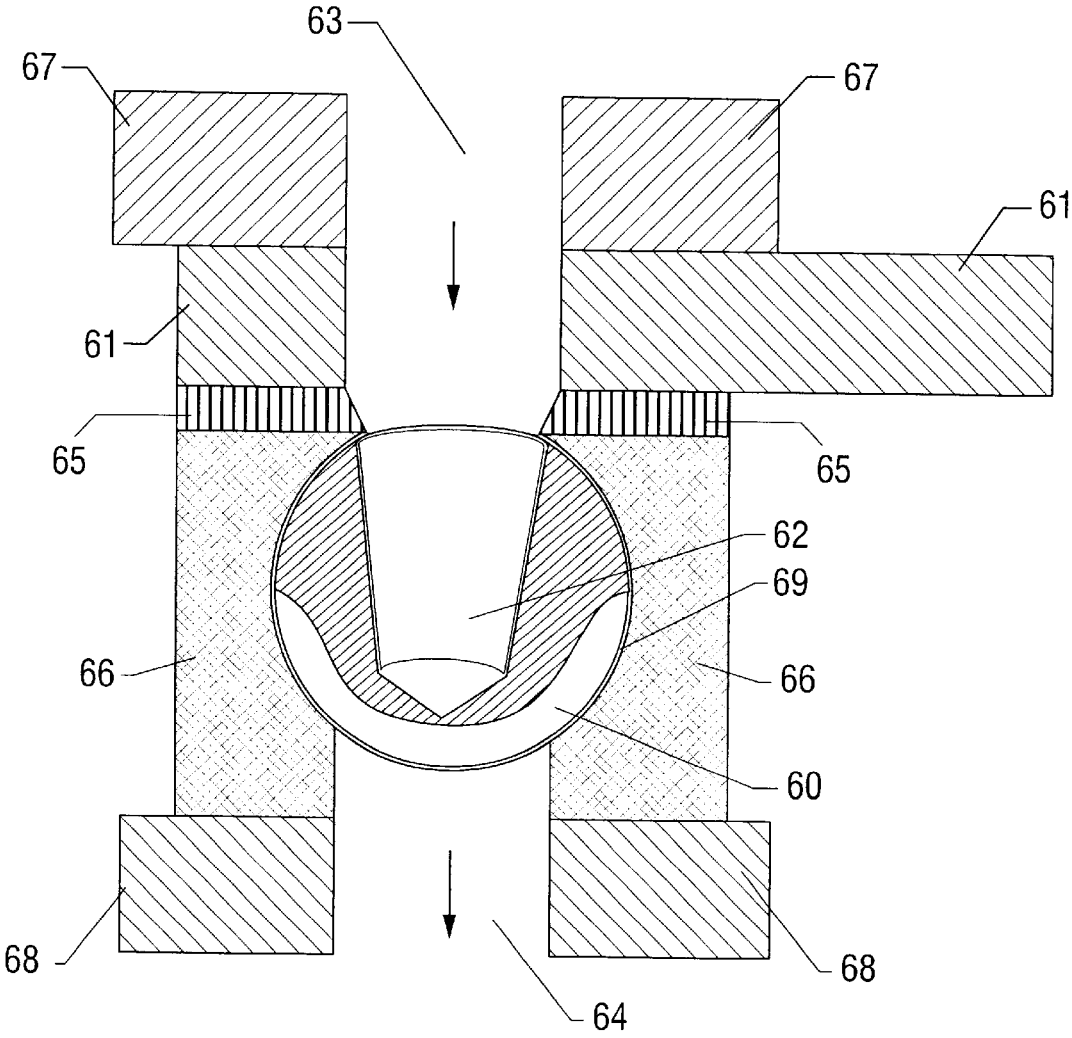
FIG. 4 illustrates a conceptual design of a process isolation valve that can be used in accordance with an embodiment of the present invention.

Additionally, as previously explained, discharge port 30 may in some embodiments be an isolation valve. A particularly preferred isolation valve that can be utilized in the various embodiments of the present invention is illustrated in FIG. 4. Specifically, FIG. 4 is a cross-sectional view of the conceptual design of the preferred isolation valve.

The process operates efficiently if there exists the ability to isolate successive process steps from each other. The preferred isolation valve can be coupled to upstream and downstream process steps by any standard means, including through the use of flanges 67 and 68. The preferred isolation valve combines a ball valve 60 with a knife valve 61. The ball valve 60 may truly have an overall shape defining a sphere. However, 8 the ball valve 60 may, depending on the overall design of the isolation valve, have a substantially cylindrical shape. For the purposes of the present invention, ball valve 60 will refer to both alternatives.

The ball valve 60 has recessed therein at least one cavity 62. Preferably, the cavity 62 is tapered so as to more readily accept and discharge material. The ball valve 60 and its cavity 62 are sized to process steel wire fragments of a maximum dimension of about 2". The taper of the ball cavity increases packing efficiency during charging and mitigates bridging of the material during discharge. With size and placement modifications, more than one cavity 62 can be recessed in the ball valve 60. A larger, single cavity 62 is preferred. The ball valve 60 can be rotated so as to receive material 8 from a charging tube 63 and to release material to a discharge tube 64. Material upstream of the ball valve 60, such as that contained in charging tube 63, is never in direct contact with material downstream from ball valve 60, such as the material in discharge tube 64. Successive steps in a process, such as the thermocatalytic conversion process presently at interest, are thus isolated from one another. The preferred isolation valve concept and design does not employ dual block valve systems with their attendant control and maintenance problems.

The knife valve 61 integrated into the isolation valve is positioned above, i.e., upstream of, the ball valve 60. The purpose of the knife valve 61 is to mitigate the scoring of the sealing surfaces of the ball valve 60 and valve body during repeated cycling of the valve. When filling of the cavity 62 is desired, the ball valve 60 is rotated to position cavity 62 to receive material from charging tube 63. The knife valve 61, preferably closed at all other times during the rotation cycle of the ball valve 60, is opened, allowing material to flow from charging tube 63 into cavity 62.

A deflection plate 65, preferably having a tapered inner face, is positioned between the ball valve 60 and knife valve 61. The deflection plate 65 directs incoming material away from the space between ball valve 60 and the isolation valve body 66 to minimize the wear on the surfaces of the ball valve 60 and the valve body 66. Use of the deflection plate 65 greatly increases the useful life of the isolation valve. The discharge of the knife valve 61 can also be fitted with a funnel shaped attachment that will even more preferentially direct the incoming material into the center of the cavity 62 and away from the contacting surfaces of the ball valve 60 and valve body 66.

The knife valve 61 is timed to close just as cavity 62 is filled and before rotation of the ball valve 60 and cavity 62 from the charge to the discharge position. This is done to prevent overfilling of cavity 62 and fouling of the space between the rotating surfaces. The discharge of the contents of the cavity 62 is primarily, if not solely, due to gravity as the cavity 62, recessed in the ball valve 60, is rotated 180° so that the cavity 62 is open to the intended direction of flow. A mild vibration of the valve body 66 will assist in reducing the time of filling and discharge. The surfaces between the ball valve 60 and the valve body 66 are preferably lubricated. Such can be achieved with a high melting, high viscosity halocarbon grease introduced, for example, through a port in the body of the isolation valve body 66. Lubrication eases the rotation of the ball valve 60, thereby assisting the transport of material. A thin seal 69, such as a molded Kalrez seal, is preferably located between ball valve 60 and valve body 66 to facilitate easy rotation while maintaining a modest pressure seal across the valve. When used in the thermocatalytic conversion process herein disclosed, each isolation valve is sized to accommodate the volume of material to be conveyed. Because of the possible contact with hydrogen chloride gas in the thermocatalytic conversion process, the ball valve 60 and the valve body 66 is preferably fabricated of corrosive resistant materials, such as stainless steel, including Type 304 stainless steel.

Another improvement apparent in the various embodiments of the present invention is the elimination of need for a solvent system. Solvents have been used to remove additives from the surface of the rubber and other feedstocks. It was determined that the combination of high catalyst to feedstock ratio and the stirring of the reactor 26 obviated the need for washing The elimination of the solvent wash makes the previous solvent stripping, recovery, and incineration steps redundant. The necessity of washing of the used tire and waste plastics particulate feedstocks is also redundant in that the unwashed particulates are inert and pass through the process unreacted, being discharged from the supplemental reactor 39 with the residue. Also the residue, containing the unwashed particulate, is washed with water in the recovery of the carbon black. The water washing removes inert and other contaminants from the carbon black slurry. This simplifies the previous wash water recycle and waste sludge disposal steps that previously have been practiced.

What is claimed is:

1. A process for the thermocatalytic conversion of waste materials into reusable hydrocarbons comprising:

a) feeding a feedstock comprising waste organic materials and catalyst comprising $AlCl_3$ to a heated, stirred reactor, wherein the reactor is maintained at positive pressures, and wherein the temperature of the reactor is sufficient to maintain $AlCl_3$ as a fluid;

b) converting feedstock into vaporized hydrocarbons;

c) removing an overhead portion comprising vaporized hydrocarbons and vaporized $AlCl_3$ from the reactor;

d) removing a reactor discharge portion comprising unreacted feedstock and catalyst from the reactor and providing the reactor discharge portion to a supplemental reactor;

e) maintaining the reactor discharge portion in the supplemental reactor at a temperature sufficient to generate additional vaporized hydrocarbons and additional vaporized $AlCl_3$;

f) removing the additional vaporized hydrocarbons and additional vaporized $AlCl_3$ catalyst from the supplemental reactor into a recycle catalyst condenser, the recycle catalyst condenser being maintained at a temperature selected to condense at least a portion of the additional vaporized $AlCl_3$ and to maintain in the vapor state at least a portion of the additional vaporized hydrocarbons;

g) removing the condensed portion of $AlCl_3$ from the recycle catalyst condenser and providing said condensed portion $AlCl_3$ to the reactor;

h) removing for recovery the portion of additional vaporized hydrocarbons maintained in the vapor state from the recycle catalyst condenser; and i) removing any residue remaining in the supplemental reactor.

2. The process of claim 1, wherein the reactor is operated in a low reactor pressure mode.

3. The process of claim 1, wherein the reactor is operated in a partial vacuum mode.

4. The process of claim 1, wherein the reactor is operated in a high reactor pressure mode.

5. The process of claim 1, wherein the catalyst additionally comprises a cocatalyst.

6. The process of claim 5, wherein the cocatalyst is a chloride salt or mixture of chloride salts of the alkali and alkaline earth metals.

7. The process of claim 5, wherein the cocatalyst comprises $MgCl_2$.

8. The process of claim 1, wherein step (c) additionally comprises (i) condensing at least a portion of the vaporized $AlCl_3$ from the overhead portion, (ii) separating via condensation the vaporized hydrocarbons in the overhead portion into a first fraction of hydrocarbons having a vapor pressure below a desired value and a second fraction of hydrocarbons having a vapor pressure above the desired value, (iii) returning the condensed $AlCl_3$ and the first fraction of hydrocarbons to the reactor, and (iv) recovering the second fraction of hydrocarbons.

9. The process of claim 8, wherein (i) and (ii) occur in a single reflux condenser.

10. The process of claim 9, wherein the reflux condenser is maintained in a temperature range of from about 50° to about 176° C.

11. The process of claim 1, wherein the volumetric ratio of catalyst to feedstock is in the range of about 0.5:1 to about 5:1.

12. The process of claim 1, wherein a purge gas is additionally provided to the reactor.

13. The process of claim 12, wherein the purge gas is selected from the group consisting of nitrogen, helium, hydrogen, methane, natural gas, and combinations thereof.

14. The process of claim 1, wherein the reactor is stirred by an orbiting mixing screw.

15. The process of claim 1, wherein the catalyst is added to the reactor via the recycle catalyst condenser.

16. The process of claim 1, wherein the residue of step i) is subjected to solid residue treatment to recover carbon black.

17. The process of claim 1, wherein isolation valves are provided to control the feeding of feedstock to the reactor, to control the removal of the reactor discharge portion from the reactor into the supplemental reactor, to control the providing of the condensed $AlCl_3$ to the reactor from the recycle catalyst condenser, and to control the removal of residue from the supplemental reactor.

18. The process of claim 1 wherein the waste organic materials are selected from the group consisting of addition polymers, condensation polymers, and combinations thereof.

19. The process of claim 1, wherein the waste organic materials are selected from the group consisting of used rubber, waste plastic, used oils and lubricants, and combinations thereof.

20. The process of claim 1, wherein the waste organic materials comprise used tire rubber.

21. The process of claim 1, wherein the waste organic materials are selected from the group consisting of aliphatic species, aromatic species, species containing both aliphatic and aromatic substituents, and combinations thereof.

22. The process of claim 1, wherein solids provided as feedstock have a maximum dimension of about 2".

23. A process for the thermocatalytic conversion of waste materials into reusable hydrocarbons comprising:

a) feeding a feedstock comprising waste organic materials and catalyst comprising $AlCl_3$ to a heated, stirred reactor, wherein the reactor is maintained at positive pressures, and wherein the temperature of the reactor is sufficient to maintain $AlCl_3$ as a fluid;

b) converting feedstock into vaporized hydrocarbons; and c) removing an overhead portion comprising vaporized hydrocarbons and vaporized $AlCl_3$ from the reactor, condensing at least a portion of the vaporized $AlCl_3$ from the overhead portion, separating via condensation the vaporized hydrocarbons in the overhead portion into a first fraction of hydrocarbons having a vapor pressure below a desired value and a second fraction of hydrocarbons having a vapor pressure above the desired value, returning the condensed $AlCl_3$ and the first fraction of hydrocarbons to the reactor, and recovering the second fraction of hydrocarbons.

24. The process of claim 23, additionally comprising the steps of:

d) removing a reactor discharge portion comprising unreacted feedstock and catalyst from the reactor and providing the reactor discharge portion to a supplemental reactor;

e) maintaining the reactor discharge portion in the supplemental reactor at a temperature sufficient to generate additional vaporized hydrocarbons and additional vaporized $AlCl_3$;

f) removing the additional vaporized hydrocarbons and additional vaporized $AlCl_3$ catalyst from the supplemental reactor into a recycle catalyst condenser, the recycle catalyst condenser being maintained at a temperature selected to condense at least a portion of the additional vaporized $AlCl_3$ and to maintain in the vapor state at least a portion of the additional vaporized hydrocarbons;

g) removing the condensed portion of $AlCl_3$ from the recycle catalyst condenser and providing said condensed portion $AlCl_3$ to the reactor;

h) removing for recovery the portion of additional vaporized hydrocarbons maintained in the vapor state from the recycle catalyst condenser; and i) removing any residue remaining in the supplemental reactor.

* * * * *